US006679793B2

(12) United States Patent
Joo

(10) Patent No.: US 6,679,793 B2
(45) Date of Patent: Jan. 20, 2004

(54) GOLF TEE STRUCTURE

(76) Inventor: Sung Yong Joo, 85-65, Samjeong-dong, Ojeong-gu, Puchon-si, Kyonggi-Do 421-150 (KR)

( * ) Notice: Subject to any disclaimer, the term of this patent is extended or adjusted under 35 U.S.C. 154(b) by 0 days.

(21) Appl. No.: 10/070,040

(22) PCT Filed: Dec. 5, 2000

(86) PCT No.: PCT/KR00/01409

§ 371 (c)(1),
(2), (4) Date: Feb. 27, 2002

(87) PCT Pub. No.: WO02/02196

PCT Pub. Date: Jan. 10, 2002

(65) Prior Publication Data

US 2002/0123396 A1 Sep. 5, 2002

(30) Foreign Application Priority Data

Jun. 30, 2000 (KR) ..... 2000-37066

(51) Int. Cl.[7] ..... A63B 57/00
(52) U.S. Cl. ..... 473/393; 473/390; 224/918
(58) Field of Search ..... 473/386, 387–403; D21/717; 224/918

(56) References Cited

U.S. PATENT DOCUMENTS

| | | | | | |
|---|---|---|---|---|---|
| 1,610,720 | A | * | 12/1926 | Walton | 473/394 |
| 1,679,579 | A | * | 8/1928 | Lundy | 473/396 |
| 2,370,529 | A | * | 2/1945 | Fuller | 473/396 |
| D279,121 | S | * | 6/1985 | Wampler | D21/717 |
| 5,782,708 | A | * | 7/1998 | Kimball, Jr. | 224/918 |
| 5,799,853 | A | * | 9/1998 | Brewster | 224/918 |
| 6,095,934 | A | * | 8/2000 | Ohama | 473/408 |

FOREIGN PATENT DOCUMENTS

| | | | |
|---|---|---|---|
| JP | 54-45673 | * | 9/1977 |
| JP | 53-10365 | * | 1/1978 |
| JP | 55-101162 | * | 7/1980 |
| JP | 64-6113 | * | 1/1989 |
| JP | 2000-176064 | * | 6/2000 |

* cited by examiner

*Primary Examiner*—Steven Wong
(74) *Attorney, Agent, or Firm*—Straub & Pokotylo; John C. Pokotylo

(57) ABSTRACT

Disclosed is a golf tee structure that is easy to use and move and prevents the loss and damage of the tee, thereby providing convenience in use and economical efficiency to a user. The golf tee structure of the present invention includes a hooker formed on the one side of a body, for carrying the golf tee structure, a plurality of tee-inserting holes formed on the other side of the body, into which three tees having different length from each other are inserted and fitted, and a coupling string connecting the body and each tee, for preventing each tee from being deviated from the body. Preferably, each tee includes a body made of a malleably synthetic resin and a metal pin on the lower portion thereof, as an integral body therewith, such that since the metal pin is driven into the ground when in use, the tee is not broken or lost. Further, the hooker formed on the body of the golf tee structure is adapted to be hooked on the loop for pants belt of a player.

10 Claims, 5 Drawing Sheets

GOLF TEE STRUCTURE

BACKGROUND OF THE INVENTION

The present invention relates to a golf tee structure that is easy to use and move and prevents the loss and damage of tees, thereby providing convenience in use and an economical efficiency to a user.

In playing golf, generally, a bar type of tee is driven into the ground in a tee box and then, a golf ball is put on the tee. Next, a player shots the ball on the tee (which is commonly called "tee-shot") by using a desired golf-club.

The tee on which the golf ball is placed is made of a general timber or synthetic resin and takes such a shape as in FIG. 5. Firstly, the timber tee 100 exhibits a low resistance but is broken against a slight impact, which results in the reduction of economical efficiency and the environmental disruption due to the broken pieces on the ground (pairway). Secondly, the synthetic resin tee 100 is not broken easily but exhibits a high resistance, which undesirably causes the specific distance of the ball to be increased.

To solve the above problems, recently, the synthetic resin tee 100 is made of a ductile material to thereby exhibit a minimized resistance.

In playing golf in the winter season, on the other hand, the conventional tee 100 is not well driven into the ground being frozen and even if driven, it is broken easily. This may give mental stress and economical loss many golfers. Additionally, in case of conducting the tee-shot in the summer season, the conventional tee 100 is drawn from the ground and as a result, it is lost.

Also, the conventional golf tee 100 is manufactured in different lengths in order to satisfy the characteristics of the golf-club to be used and the preference of the player. Generally, three kinds of tees, for example, long, middle and short tees are provided, which are put into a player's pocket or a separate tee retaining instrument during playing. In order to conduct the play without delay in the case where the tees the player retains have been lost or damaged, however, the player should always prepare spare or new ones.

SUMMARY OF THE INVENTION

It is, therefore, an object of the present invention to provide a golf tee structure where three kinds of tees can be all carried and kept in a convenient manner, the loss and damage of the tees can be minimized, and particularly, the tee can be driven into the ground in an easy manner in the condition where the ground is frozen in the winter season.

To attain this and other objects of the present invention, there is provided a golf tee structure comprising: a hooker formed on the one side of a body, for carrying the golf tee structure; a plurality of tee inserting holes formed on the other side of the body, into which a plurality of tees having different lengths from each other are inserted and fitted; and a coupling string connecting the body and each of the plurality of tees, for preventing each of the plurality of tees from being deviated from the body.

Preferably, each of the plurality of tees includes a tee body made of a malleably synthetic resin and a metal pin on the lower portion thereof, as an integral body therewith, such that since the metal pin is driven into the ground when in use, the tee cannot be broken or lost. Further, the hooker formed on the body of the golf tee structure is adapted to be hooked on the loop for pants belt of a player.

DETAILED DESCRIPTION OF THE PREFERRED EMBODIMENT

Figure 1:
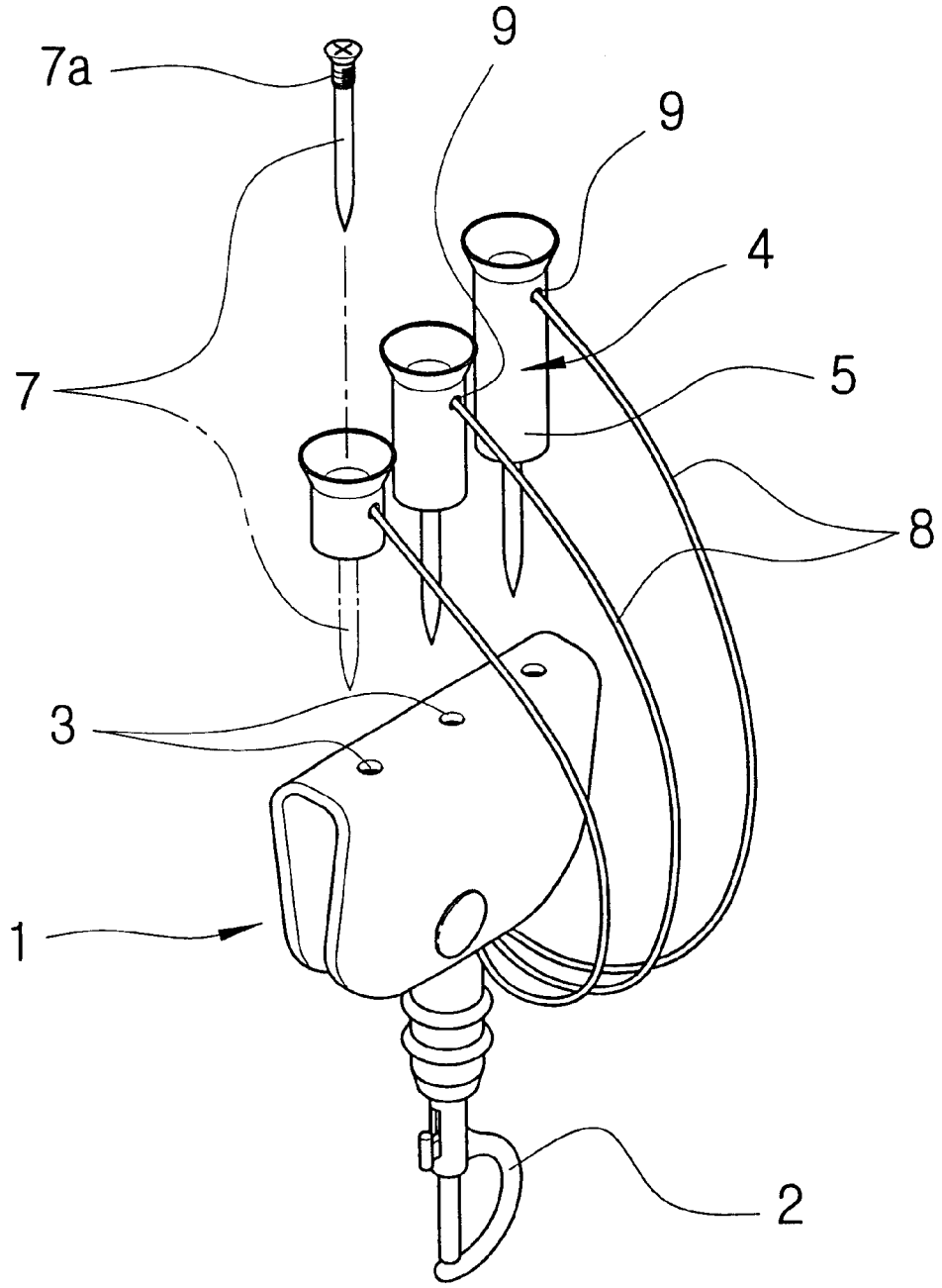
FIG. 1 is an exploded perspective view illustrating a golf tee structure according to the present invention.
Figure 2:
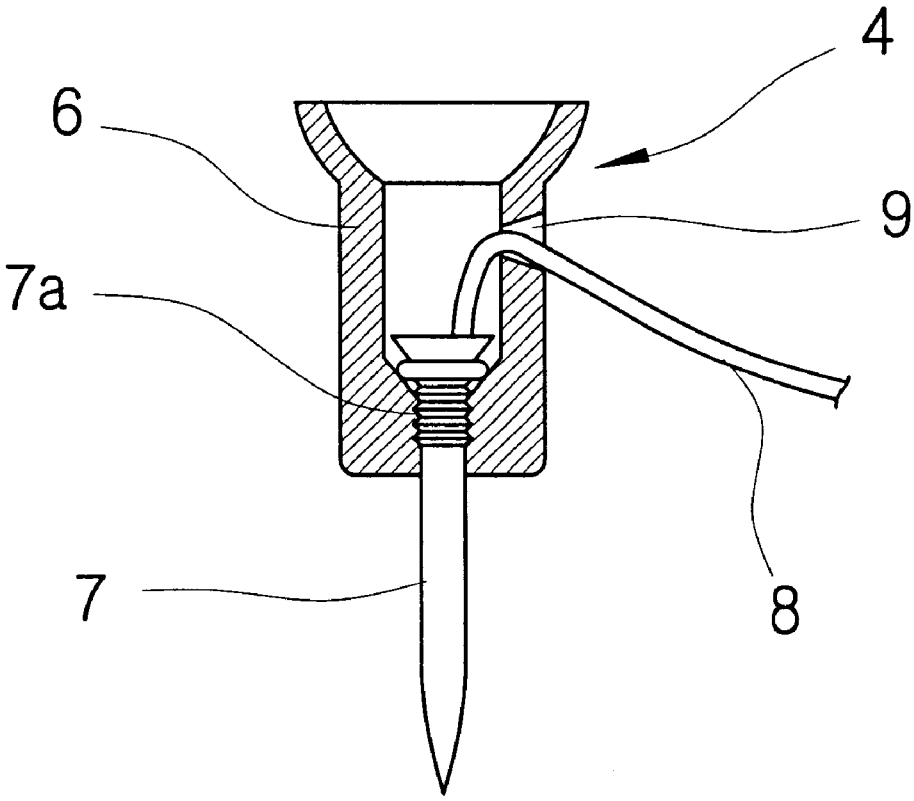
FIG. 2 is a sectional view illustrating the tee in FIG. 1.
Figure 3:
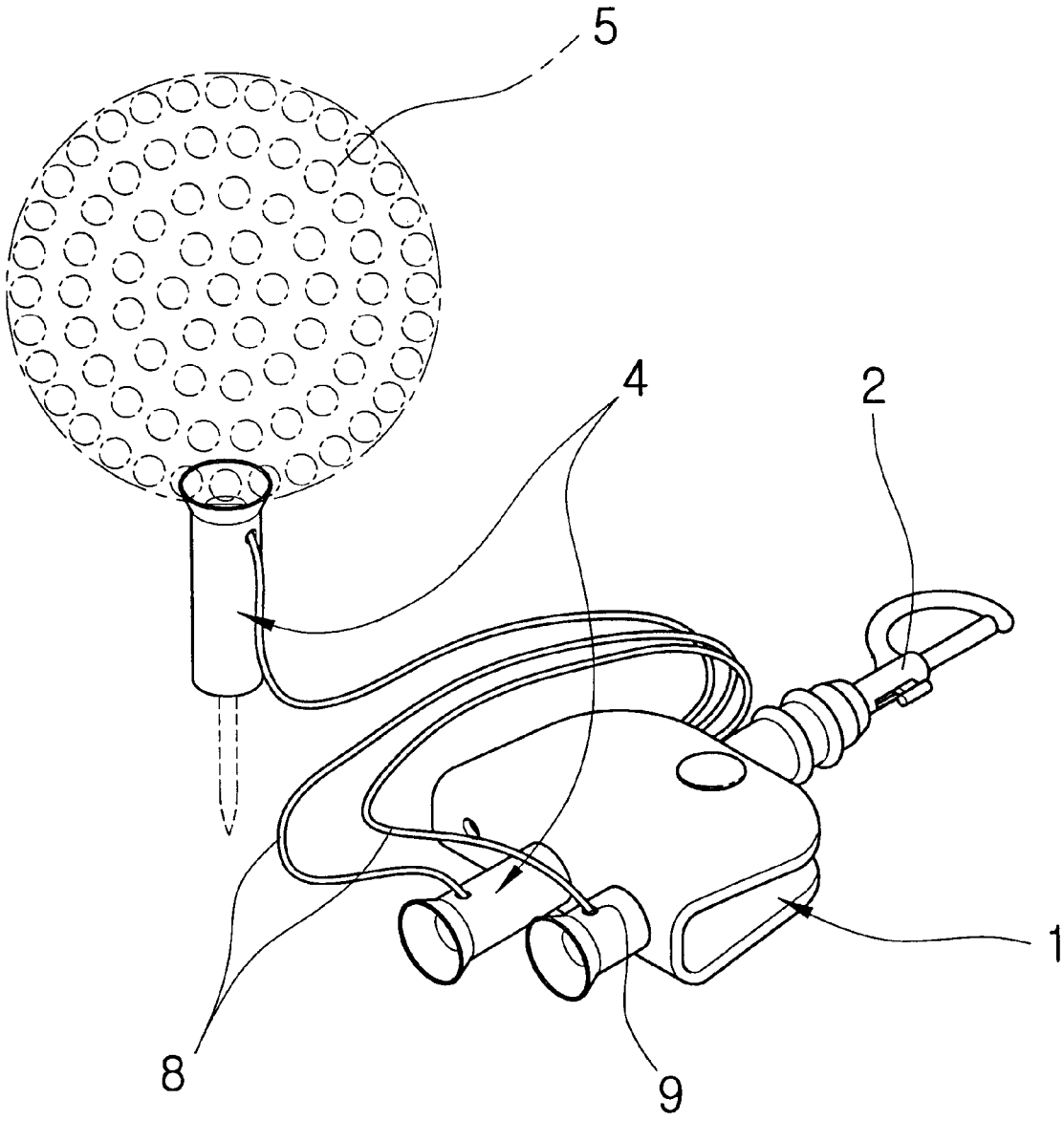
FIG. 3 is a perspective view illustrating the use state of the golf tee structure according to the present invention.
Figure 4:
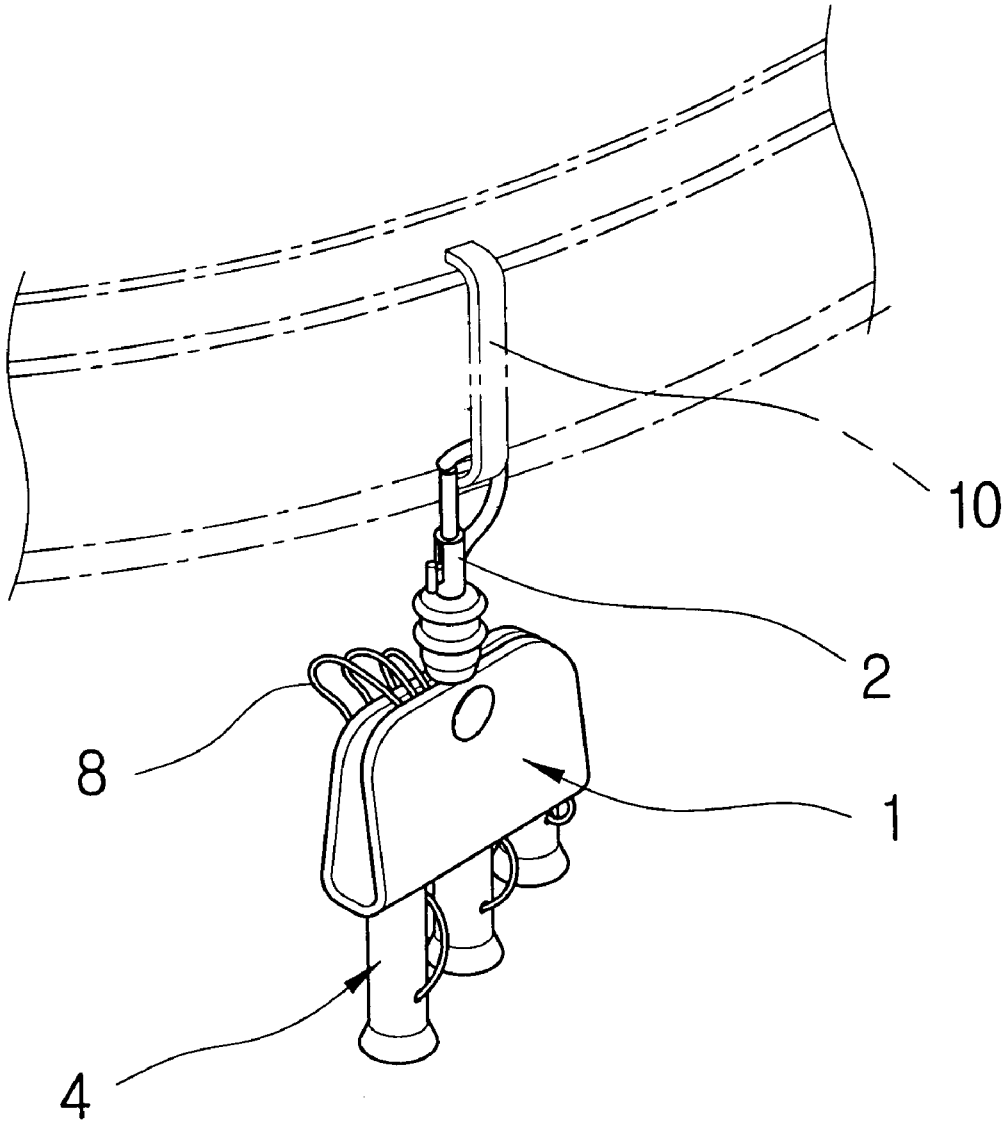
FIG. 4 is a perspective view illustrating the golf tee structure according to the present invention which is carried along with a user's body.
Figure 5:
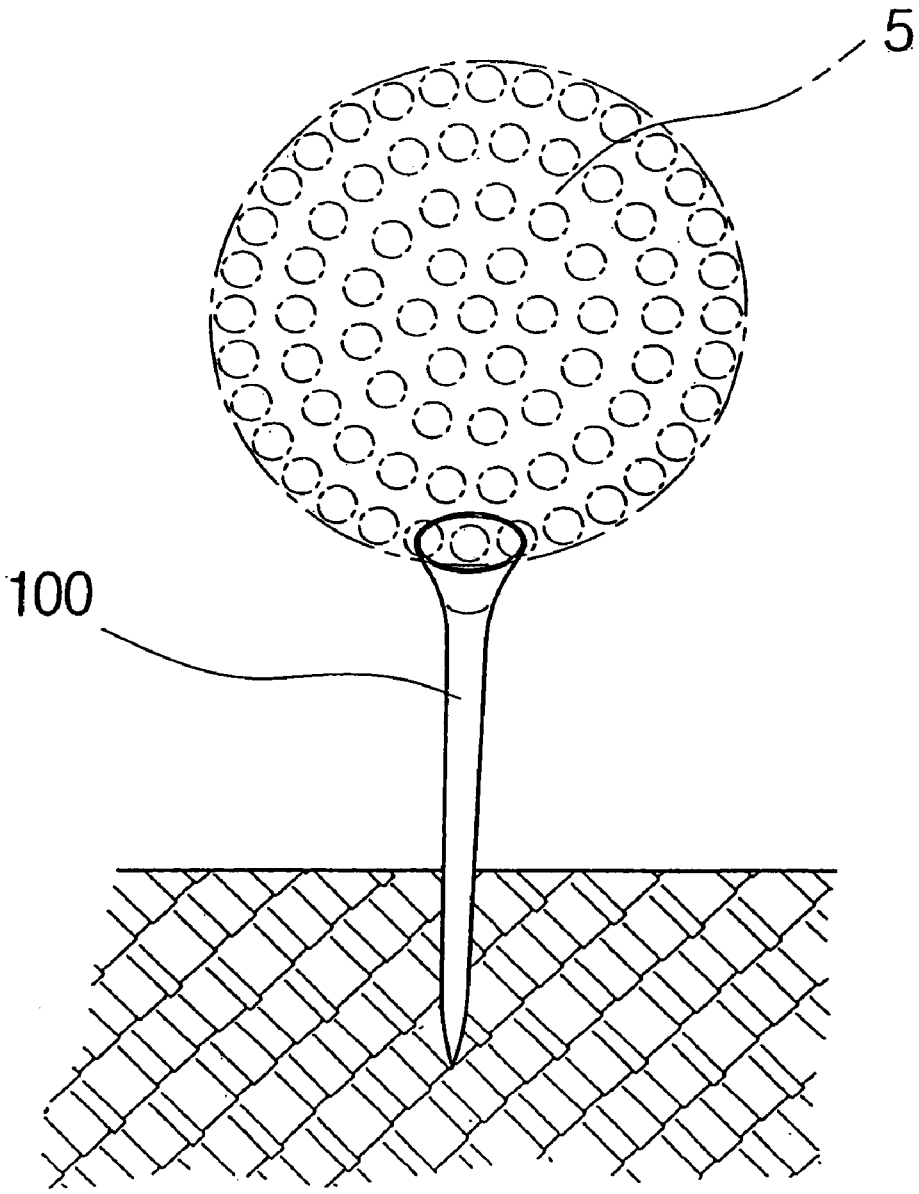
FIG. 5 Prior Art
FIG. 5 is a perspective view illustrating a conventional tee.

FIG. 1 is an exploded perspective view illustrating a golf tee structure according to the present invention, FIG. 2 is a sectional view illustrating the tee in FIG. 1, FIG. 3 is a perspective view illustrating the use state of the golf tee structure according to the present invention, and FIG. 4 is a perspective view illustrating the golf tee structure according to the present invention which is carried along with a user's body.

A reference numeral '1' denotes a body of the golf tee structure according to the present invention, which is made of a smooth and durable material, for example, leather. The body 1 includes a hooker 2 formed as an integral body on the one side thereof and a plurality of tee inserting holes 3 formed on the opposite side to the hooker 2.

A reference numeral '4' denotes the tee having different lengths, which is comprised of a tee body 6 having an upper portion of a relatively large diameter on which a golf ball 5 is placed and a metal pin 7 secured integrally on the lower portion of the tee body 6.

Further, a string 8 is provided between the body 1 and each of the tees 4, for preventing the tee 4 from being lost.

On the other hand, it is preferable that the tee body 6 is made of a malleably synthetic resin material and the metal pin 7 forms a helix on the upper portion thereof to be screw-inserted into the tee body 6 and takes a nail shape on the lower portion thereof. As shown in FIG. 2, the string 8, which is connected between each tee 4 and the body 1, puts fixedly the one side end thereof between the head portion of the pin 7 inserted into the tee body 6 and the tee body 6, is drawn from a string drawing hole 9 formed on the tee body 6 and then fixes the other side end thereof on the coupling portion of the hooker 2 and the body 1.

On the other hand, it is preferable that the tees 4 are provided as a set of tees, for example, long, middle and short tees, in order to satisfy general tee kinds. Hence, the body 1 forms the three tee inserting holes 3 through which the three kinds of tees 4 are inserted.

Under the above construction, an explanation of the golf tee structure in an operation state according to the present invention will be discussed.

If the player is to shot the tee in the tee box, as shown in FIG. 3, he selects his desired tee 4 and drives the pin 7 of the tee 4 into the ground. As a result, the golf ball 5 is placed on the tee 4 separated by a predetermined height on the ground and the other tees 4 remain on the ground, while being coupled to the body 1.

If he shots the tee in the above state, the tee 4 is never lost by the connection to the body 1 by means of the string 8, even in case where the tee 4 is hit by the head of the golf-club and is thus drawn from the ground.

After use, if he is to carry the golf tee structure according to the present invention, the pin 7 of the tee 4 used is inserted into the tee-inserting hole 3 on the body 1 and the hooker 2 is hooked to the pants loop 10 for his belt. Further, if the use of the tee 4 is completed, the hooker 2 is hooked to a caddie bag.

According to the golf tee structure of the present invention, the tees 4 are easy to be carried and kept in any place and can be selected at any time, if necessary.

More particularly, even in the condition where the ground is frozen and very rigid in the winter season, the tee 4 of the present invention is made of the metal material, such that it can be well driven into the ground without any inconvenience. Furthermore, even though the head of the golf-club is hit on the tee, the pin 7 supported under the ground is made of the metal material, such that it cannot be well broken.

According to the golf tee structure of the present invention, the pin 7 of the tee 4 is hard and has a relatively small diameter, such that it can be replaced with a marker when the player putts on the green.

As set forth in the foregoing, a golf tee structure according to the present invention is provided with a body where a hooker and a plurality of tee-inserting holes for three kinds of tees are formed, whereby it is convenient to use, with a string connecting the body and each tee, whereby it cannot be lost during tee-shot, and with a pin of each tee being made of a metal material, whereby it can be easily driven into the ground even in the condition where the ground is frozen and hard in the winder season and cannot be well broken even though the head of the golf-club is hit on the tee.

What is claimed is:

1. A golf tee structure comprising:

a body;

a hooker formed on one side of said body, for carrying said golf tee structure;

a plurality of tees having different lengths;

a plurality of tee-inserting holes formed on another side of said body, into which said plurality of tees having different lengths are inserted and fitted; and a plurality of coupling strings, each of said plurality of coupling strings connecting said body and one of each of said plurality of tees, for preventing each of said plurality of tees from being deviated from said body.

2. A golf tee structure according to claim 1, wherein each of said plurality of tees is comprised of a body made of a malleably synthetic resin and a metal pin on the lower portion thereof, as an integral body therewith.

3. The golf tee structure of claim 1 wherein each of said plurality of tees includes a pin attached with a tee body, and wherein each of said plurality of coupling strings is attached to the pin and extends through the tee body of its corresponding tee.

4. The golf tee structure of claim 1 wherein each of said plurality of coupling strings extends from an upper portion of its corresponding tee.

5. The golf tee structure of claim 1 wherein said body is formed of a folded piece.

6. The golf tee structure of claim 5 wherein the body is leather.

7. The method of claim 5 wherein the folded piece forming the body includes an open end and a closed end.

8. The golf tee structure of claim 7 wherein the body is leather.

9. The method of claim 7 wherein the plurality of tee inserting holes are formed in the closed end of the folded piece.

10. The method of claim 9 wherein the body is leather.

* * * * *